US009273397B2

(12) United States Patent
Goto et al.

(10) Patent No.: US 9,273,397 B2
(45) Date of Patent: Mar. 1, 2016

(54) METHOD FOR INSPECTING LIQUID DROPLET EJECTION APPARATUS

(71) Applicant: Panasonic Corporation, Osaka (JP)

(72) Inventors: Masashi Goto, Hyogo (JP); Takayuki Miyoshi, Hyogo (JP); Masahiro Muro, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 14/624,800

(22) Filed: Feb. 18, 2015

(65) Prior Publication Data

US 2015/0259784 A1 Sep. 17, 2015

(30) Foreign Application Priority Data

Mar. 11, 2014 (JP) ..... 2014-047617

(51) Int. Cl.
*C23C 14/24* (2006.01)
*C23C 14/52* (2006.01)
*C23C 18/00* (2006.01)

(52) U.S. Cl.
CPC ..... *C23C 18/00* (2013.01)

(58) Field of Classification Search
CPC ..... C23C 14/24; C23C 14/52
USPC ..... 347/9–20, 54
See application file for complete search history.

(56) References Cited

U.S. PATENT DOCUMENTS

2012/0287186 A1* 11/2012 Tanaka ..... B41J 2/0451 347/10
2013/0208042 A1* 8/2013 Ueshima ..... B41J 29/393 347/19

FOREIGN PATENT DOCUMENTS

JP 2002-318556 10/2002
JP 2010-120237 6/2010

* cited by examiner

*Primary Examiner* — Manish S Shah
*Assistant Examiner* — Roger W Pisha, II
(74) *Attorney, Agent, or Firm* — Panasonic Patent Center

(57) ABSTRACT

A method for inspecting a liquid droplet ejection apparatus that ejects a liquid droplet from an ejection port includes (a) ejecting the liquid droplet toward an ejection target at an inspection drive frequency that is higher than an operation drive frequency set during a normal operation; (b) measuring a characteristic of the liquid droplet deposited on a surface of the ejection target; and (c) determining that the ejection port the characteristic of which is outside a predetermined range is defective.

7 Claims, 10 Drawing Sheets

FIG. 6

| IMAGE CAPTURING REGION | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| AREA ($\mu m^2$) | 25 | 30 | 15 | 40 | 25 | 30 | 28 | 28 | 20 | 30 | 24 | 23 | 30 | 30 | 20 |
| UPPER LIMIT ($\mu m^2$) | 35 | 35 | 35 | 35 | 35 | 35 | 35 | 35 | 35 | 35 | 35 | 35 | 35 | 35 | 35 |
| LOWER LIMIT ($\mu m^2$) | 20 | 20 | 20 | 20 | 20 | 20 | 20 | 20 | 20 | 20 | 20 | 20 | 20 | 20 | 20 |
| PASS/FAIL DETERMINATION | ○ | ○ | × | × | ○ | ○ | ○ | ○ | ○ | ○ | ○ | ○ | ○ | ○ | ○ |

FIG. 8

| LIQUID SOLUTION | INK 1 | INK 2 | INK 3 |
|---|---|---|---|
| INK VISCOSITY [mPa·s] | 8.3 | 9.7 | 12.3 |

METHOD FOR INSPECTING LIQUID DROPLET EJECTION APPARATUS

CROSS REFERENCES TO RELATED APPLICATIONS

This application claims priority to Japanese Patent Application No. 2014-047617, filed on Mar. 11, 2014, the contents of which are hereby incorporated by reference.

BACKGROUND

1. Technical Field

The present disclosure relates to a method for inspecting a liquid droplet ejection apparatus and a method for manufacturing a device.

2. Description of the Related Art

Devices such as an organic light emitting device and a thin-film transistor (TFT) board have a functional layer formed on a substrate. The functional layer has a specific function. Examples of the functional layer includes an organic light emitting layer of an organic light emitting device and an organic semiconductor layer of a TFT board. In recent years, such devices have grown in size. To efficiently form a functional layer on a large sized substrate, a technique called "wet process" has been developed. The term "wet process" refers to a technique for applying liquid solution containing a functional material (hereinafter also referred to as "ink") to a substrate using, for example, an inkjet technique. For example, according to the inkjet technique, an ejection target is placed on a work table of an ink droplet ejection apparatus first. Subsequently, an inkjet head is scanned over the ejection target and, simultaneously, liquid droplets are ejected from a plurality of ejection ports. Thereafter, the liquid droplets deposited on the surface of the ejection target are dried. In this manner, the functional layer is formed (refer to, for example, Japanese Unexamined Patent Application Publication No. 2002-318556). In addition, according to an inkjet technique, inspection of ejection ports is performed as needed. For example, Japanese Unexamined Patent Application Publication No. 2010-120237 describes a technique in which liquid droplets are continuously ejected under a drive condition that is severer than a normal drive condition. Immediately after the ejection, liquid droplets are ejected under a normal drive condition. Thereafter, it is determined whether each of the ejection ports normally functions by determining whether a liquid droplet is ejected from the ejection port.

SUMMARY

One non-limiting and exemplary embodiment provides a method for inspecting a liquid droplet ejection apparatus and a method for manufacturing a device capable of detecting, at a stage prior to the device manufacturing process, an ejection port that is likely to have an accidental defective ejection in the device manufacturing process.

Additional benefits and advantages of the disclosed embodiments will be apparent from the specification and Figures. The benefits and/or advantages may be individually provided by the various embodiments and features of the specification and drawings disclosure, and need not all be provided in order to obtain one or more of the same.

In one general aspect, the techniques disclosed here feature a method for inspecting a liquid droplet ejection apparatus that ejects a liquid droplet from an ejection port. The method includes: (a) ejecting the liquid droplet toward an ejection target at an inspection drive frequency that is higher than an operation drive frequency set during a normal operation; (b) measuring a characteristic of the liquid droplet deposited on a surface of the ejection target; and (c) determining that the ejection port the characteristic of which is outside a predetermined range is defective.

These general and specific aspects may be implemented using a system, a method, and a computer program, and any combination of systems, methods, and computer programs.

BRIEF DESCRIPTION OF THE DRAWINGS

FIG. 6 illustrates a data table according to the exemplary embodiment;

FIG. 8 illustrates the viscosity of ink used in the evaluation in FIG. 7;

DETAILED DESCRIPTION

Figure 1:
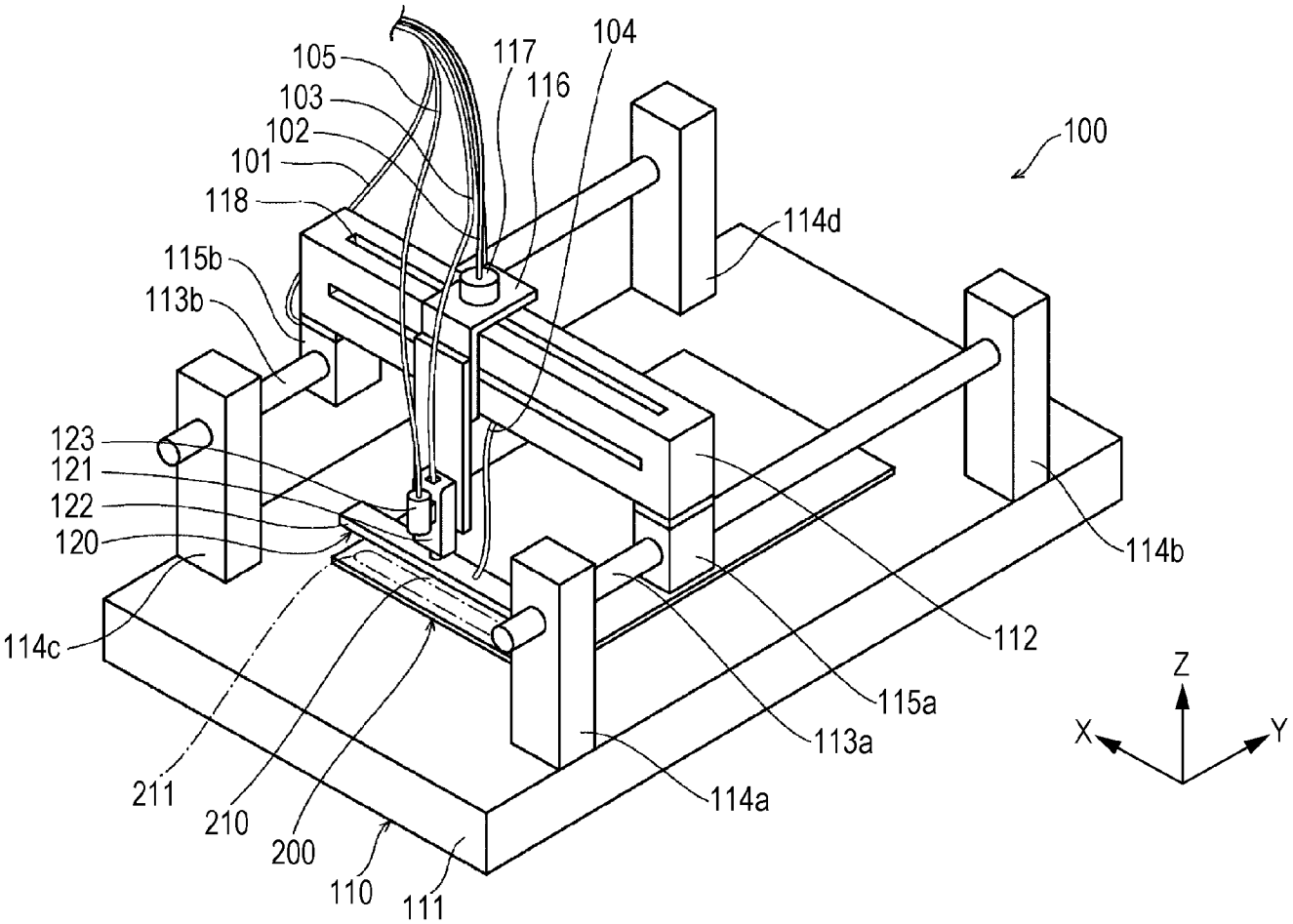
FIG. 1 illustrates the main configuration of a liquid droplet ejection apparatus according to an exemplary embodiment of the present disclosure.

Underlying Knowledge Forming Basis of the Present Disclosure

To form a functional layer with high positional accuracy using an inkjet technique, the drop landing accuracy of a liquid droplet ejection apparatus needs to meet a predetermined standard. That is, it is necessary to deposit a desired volume of a liquid droplet at a desired position. However, among a plurality of ejection ports of the liquid droplet ejection apparatus, there may be ejection ports that do not meet the predetermined standard of drop landing accuracy due to fixing of ink or dirt on the ejection ports and their vicinity, that is, ejection ports that cause drop landing error. If such an ejection port is included in the liquid droplet ejection apparatus, a produced device may malfunction. For example, if the ejection port that causes drop landing error is continuously used to form an organic light emitting layer of an organic electroluminescence (EL) device, an ink droplet may land on a sub-pixel adjacent to a target sub-pixel. If such a situation occurs, the ink that forms a light emitting layer may have a mixed color and, thus, the color of the emitted light may be undesired color.

Accordingly, periodical maintenance of the nozzles of the liquid droplet ejection apparatus is required to remove the factors that cause nozzle clogging. In general, inspection of the liquid droplet ejection apparatus is performed before, for example, manufacturing of a device is started.

However, if devices are continuously manufactured, even an ejection port that is inspected as being normal may happen to have defective ejection of ink. If such defective ejection occurs, the manufacturing line needs to be stopped in order to perform a maintenance operation of the liquid droplet ejection apparatus, which results in a decrease in the yield ratio. Accordingly, the present inventors studied a method for detecting an ejection port that is likely to have defective ejection in advance and found that by causing an ejection port to eject liquid droplets at a drive frequency that is higher than that in a normal operation and measuring the characteristics of the ejected liquid droplets, an ejection port having defective ejection or non-ejection can be detected.

Outline of Exemplary Embodiment

According to an aspect of the present disclosure, a method for inspecting a liquid droplet ejection apparatus that ejects a liquid droplet from an ejection port includes: (a) ejecting the liquid droplet toward an ejection target at an inspection drive frequency that is higher than an operation drive frequency set during a normal operation; (b) measuring a characteristic of the liquid droplet deposited on a surface of the ejection target; and (c) determining that the ejection port the characteristic of which is outside a predetermined range is defective.

According to the method for inspecting a liquid droplet ejection apparatus, an ejection port that is likely to have accidental defective ejection in a manufacturing process can be detected and selected out in a pre-stage of a device manufacturing process. Thus, the liquid solution can be continuously applied in the manufacturing process. As a result, a decrease in the yield ratio can be prevented and, thus, the production efficiency can be increased.

In the above-described method for inspecting a liquid droplet ejection apparatus, the measuring (b) may include: (b-1) capturing an image of the liquid droplet deposited on the surface of the ejection target; and (b-2) measuring the characteristic on the basis of the image.

In addition, in the above-described method for inspecting a liquid droplet ejection apparatus, the inspection drive frequency may be 1.8 times higher than or equal to the operation drive frequency and 36.7 times lower than the operation drive frequency. Furthermore, the characteristic may be at least one of an area of the liquid droplet, deviation of a drop landing position of the liquid droplet, a variation of the drop landing position, a frequency of an occurrence of non-ejection, a frequency of an occurrence of a satellite phenomenon, and a frequency of an occurrence of a double drop phenomenon.

In addition, the above-described method for inspecting a liquid droplet ejection apparatus may further include: (d) determining that it is possible for the normal operation to be continuously performed by using ejection ports other than one or more ejection ports determined to be defective in the determining (c), in a case where a ratio of a number of the one or more ejection ports determined to be defective in the determining (c) to a total number of ejection ports is lower than or equal to a predetermined value. Furthermore, the predetermined value may be less than or equal to 8%.

According to another aspect of the present disclosure, a method for manufacturing a device including a layer formed by using a liquid droplet ejection apparatus that ejects a liquid droplet from an ejection port is provided. The method includes (a) ejecting the liquid droplet toward an ejection target at an inspection drive frequency that is higher than an operation drive frequency set during a normal operation; (b) measuring a characteristic of the liquid droplet deposited on a surface of the ejection target; (c) determining that the ejection port the characteristic of which is outside a predetermined range is defective; and (d) forming the layer by ejecting liquid droplets by using ejection ports other than one or more ejection ports determined to be defective in the determining (c) at the operation drive frequency, in a case where a ratio of a number of the one or more ejection ports determined to be defective in the determining (c) to a total number of ejection ports is lower than or equal to a predetermined value.

In the above-described method for manufacturing a device, the characteristic may be at least one of an area of the liquid droplet, deviation of a drop landing position of the liquid droplet, a variation of the drop landing position, a frequency of an occurrence of non-ejection, a frequency of an occurrence of a satellite phenomenon, and a frequency of an occurrence of a double drop phenomenon.

Exemplary Embodiment

A method for inspecting a liquid droplet ejection apparatus and a method for manufacturing a device according to the present exemplary embodiment are described below with reference to the accompanying drawings.

Liquid Droplet Ejection Apparatus

Architecture

Figure 2:
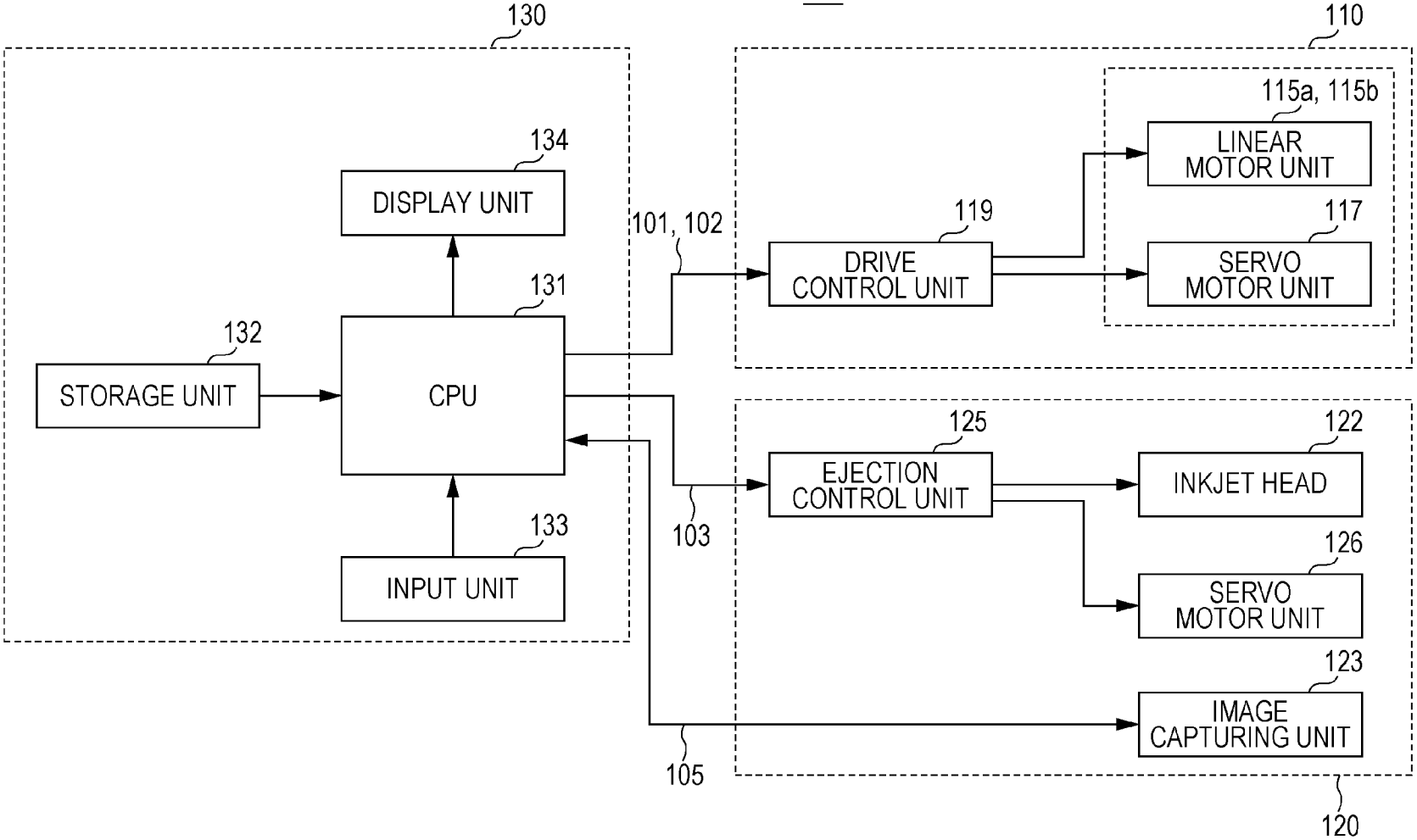
FIG. 2 is a functional block diagram of a liquid droplet ejection apparatus according to an exemplary embodiment of the present disclosure.

FIG. 1 illustrates the main configuration of the liquid droplet ejection apparatus according to an exemplary embodiment. FIG. 2 is a functional block diagram of the liquid droplet ejection apparatus. As illustrated in FIGS. 1 and 2, a liquid droplet ejection apparatus 100 includes a work table 110, a head unit 120, and a control unit 130.

Work Table

The work table 110 is configured as a work table of a gantry type. The work table 110 includes a plate-like supporting base 111 that allows an ejection target 200 to be placed thereon and an elongated movable trestle 112 disposed above the supporting base 111. In FIG. 1, a substrate 200 for inspection of drop landing is placed so as to serve as the ejection target 200.

The movable trestle 112 is disposed so that the long direction thereof coincides with the short direction of the supporting base 111 (an X-axis direction). The movable trestle 112 is disposed so as to bridge between the guide shafts 113*a* and 113*b*, which are disposed parallel along the long direction of the supporting base 111 (a Y-axis direction). The guide shafts 113*a* and 113*b* are supported by columnar stands 114*a* to 114*d* disposed at the four corners of the top surface of the supporting base 111.

The guide shafts 113*a* and 113*b* have linear motor units 115*a* and 115*b* mounted thereon, respectively. Both ends of the movable trestle 112 in the long direction are fixed to the linear motor units 115*a* and 115*b*. By moving the linear motor units 115*a* and 115*b* along the guide shafts 113*a* and 113*b* in the Y-axis direction, respectively, the movable trestle 112 is moved in the Y-axis direction.

The movable trestle 112 has an L-shaped mounting base 116 attached thereto. The L-shaped mounting base 116 has a servo motor unit 117 mounted thereon. A gear (not illustrated) is attached to a top end of a motor shaft (not illustrated) of the servo motor unit 117. The gear is fitted into a guide groove 118 of the movable trestle 112. The guide groove 118 is formed so as to extend in the long direction of the movable trestle 112. The guide groove 118 has a rack having fine teeth (not illustrated) therein, and the rack is meshed with the gear.

If the servo motor unit 117 is operated, the L-shaped mounting base 116 moves in the X-axis direction through a so-called pinion-rack mechanism.

The mounting base 116 has a head unit 120 mounted thereon. If the servo motor unit 117 is operated and, thus, the mounting base 116 is moved in the X-axis direction, the head unit 120 is moved in the X-axis direction. In this manner, an inkjet head 122 and an image capturing unit 123 of the head unit 120 can scan in the X-axis direction. In addition, if the linear motor units 115*a* and 115*b* are operated and, thus, the movable trestle 112 is moved in the Y-axis direction, the mounting base 116 and the head unit 120 are also moved in the Y-axis direction. In this manner, the inkjet head 122 and the image capturing unit 123 of the head unit 120 can scan in the Y-axis direction in addition to the X-axis direction.

The linear motor units 115*a* and 115*b* and the servo motor unit 117 are connected to a drive control unit 119 that controls the linear motor units 115*a* and 115*b* and the servo motor unit 117. The drive control unit 119 is connected to a central processing unit (CPU) 131 of the control unit 130 via communication cables 101 and 102. The CPU 131 sends an instruction to the drive control unit 119 on the basis of a predetermined control program stored in a storage unit 132. The drive controls unit 119 controls driving of the linear motor units 115*a* and 115*b* and the servo motor unit 117 on the basis of the instruction.

Head Unit

Figure 3:
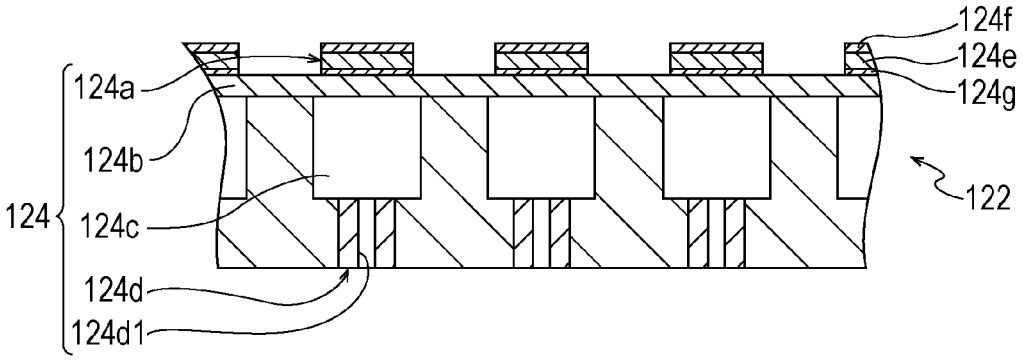
FIG. 3 is a cross-sectional view of a schematic configuration of an inkjet head.

The head unit 120 includes a main body 121, the inkjet head 122, and the image capturing unit 123. The main body 121 is fixed to the mounting base 116. The inkjet head 122 and the image capturing unit 123 are mounted on the main body 121. FIG. 3 is a cross-sectional view of a schematic configuration of an inkjet head. As illustrated in FIG. 3, the inkjet head 122 is an elongated member including a plurality of ink ejection mechanism units 124 (for example, several thousands). The ink ejection mechanism units 124 are arranged in a line in a long direction of the inkjet head 122 at equal intervals. Each of the ink ejection mechanism units 124 includes a piezoelectric element 124*a*, a vibration plate 124*b*, a liquid chamber 124*c*, and a nozzle 124*d*. The nozzle 124*d* has an ejection ports 124*d*1.

For example, the piezoelectric element 124*a* is a laminated body formed by sandwiching a plate-like piezoelectric body 124*e* made of, for example, lead zirconate titanate by two electrodes 124*f* and 124*g*. By applying a waveform voltage at a several hundred Hz frequency between the two electrodes, the piezoelectric element 124*a* deforms. The vibration plate 124*b* is a thin plate made of a stainless steel or nickel and serves as a top panel of the liquid chamber 124*c*. The piezoelectric element 124*a* is disposed on an upper surface of the vibration plate 124*b* at a position corresponding to the liquid chamber 124*c*. If the piezoelectric element 124*a* deforms, the vibration plate 124*b* also deforms and, thus, the volume of the liquid chamber 124*c* varies.

The liquid chamber 124*c* provides a space for reserving ink. The ink is supplied from the outside into the liquid chamber 124*c* via a liquid transport tube 104 connected to the inkjet head 122. When the volume of the liquid chamber 124*c* decreases, the ink in the liquid chamber 124*c* is ejected from the ejection ports 124*d*1 to the ejection target 200 in the form of liquid droplets.

The ejection ports 124*d*1 communicate with the liquid chamber 124*c*. A plurality of the ejection ports 124*d*1 (e.g., several thousand ejection ports 124*d*1) are arranged in a line on a surface of the inkjet head 122 that faces the supporting base 111, that is, a lower surface of the inkjet head 122 at equal intervals. Note that the ejection ports 124*d*1 are not necessarily arranged in a line. For example, the ejection ports 124*d*1 may be arranged in a plurality of lines. When the ejection ports 124*d*1 are arranged in a plurality of lines, the ejection ports 124*d*1 may be arranged in a staggered arrangement. In this manner, the pitch of the ejection ports 124*d*1 can be reduced.

As illustrated in FIG. 2, an ejection control unit 125 includes a drive circuit that independently drives the piezoelectric elements 124*a*. The ejection control unit 125 is included in the main body 121. The ejection control unit 125 controls a drive signal provided to each of the piezoelectric elements 124*a* so that each of the ejection ports 124*d*1 ejects a liquid droplet. For example, the ejection control unit 125 controls a drive voltage pulse to be applied to the piezoelectric element 124*a* and controls, for example, the volume of the liquid droplet ejected from the ejection port 124*d*1 and the ejection timing.

The ejection control unit 125 is connected to the CPU 131 of the control unit 130 via a communication cable 103. The CPU 131 sends an instruction to the ejection control unit 125 on the basis of a predetermined control program stored in the storage unit 132. The ejection control unit 125 applies a predetermined drive voltage to the piezoelectric element 124*a* to be controlled in accordance with the received instruction.

The main body 121 includes a servo motor unit 126. If the servo motor unit 126 is operated, the inkjet head 122 rotates in an X-Y plane. By controlling the rotation angle, a pitch of the ejection port 124*d*1 relative to the ejection target can be controlled.

The image capturing unit 123 is, for example, a CCD camera. The image capturing unit 123 is connected to the CPU 131 of the control unit 130 via a communication cable 105. When the drop landing accuracy of the liquid droplet ejection apparatus 100 is inspected, an instruction to capture an image is sent from the CPU 131. Upon receiving the instruction, the image capturing unit 123 captures the image of the surface of an ejection target placed on the supporting base 111. Thereafter, the captured image is sent to the control unit 130. The CPU 131 performs processing on the sent image on the basis of a predetermined program stored in the storage unit 132.

Control Unit

The control unit 130 includes the CPU 131, the storage unit 132 (including a mass-storage unit, such as an HDD), an input unit 133, a display unit (a display) 134. More specifically, the control unit 130 is, for example, a personal computer (PC). The storage unit 132 stores, for example, control programs for driving the work table 110 and the head unit 120. When the liquid droplet ejection apparatus 100 is driven, the CPU 131 performs predetermined control on the basis of an instruction input by an operator through the input unit 133 and the control programs stored in the storage unit 132.

Method for Inspecting Liquid Droplet Ejection Apparatus

In inspection of the liquid droplet ejection apparatus, a liquid droplet is ejected from each of the ejection ports into an inspection region provided in a peripheral portion of a half-finished device. Thereafter, the image of the inspection region having the liquid droplet deposited thereonto is captured, and positional deviation and the volume of each of the liquid droplets are measured on the basis of the captured image of the liquid droplet. More specifically, for example, the image of the inspection region having the liquid droplet deposited therein is captured using a CCD camera. Thereafter, the image of the liquid droplet is extracted from the captured image using, for example, pattern matching, and the drop landing position and the area of the liquid droplet are read.

Figure 4A:
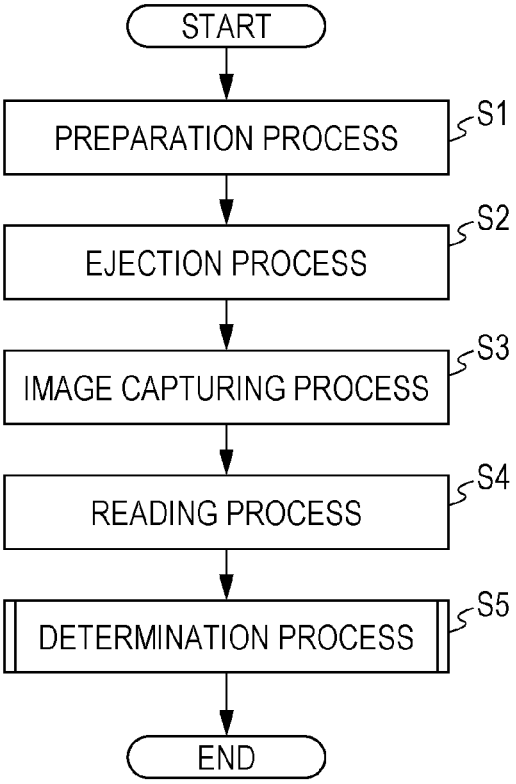
FIG. 4A is a process chart illustrating a method for inspecting a liquid droplet ejection apparatus according to the exemplary embodiment and FIG. 4B is a process chart illustrating a determination method in a determination process (step S5) in FIG. 4A.
Figure 4B:
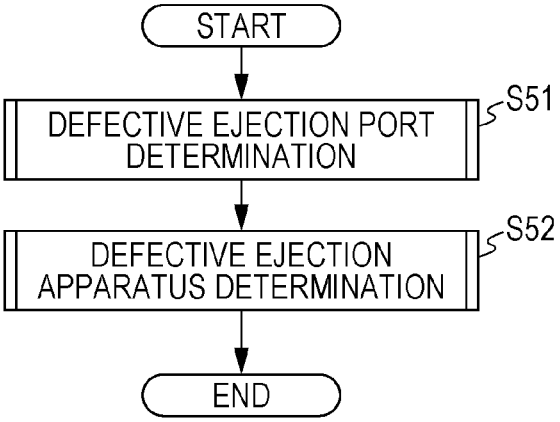
Figure 5:
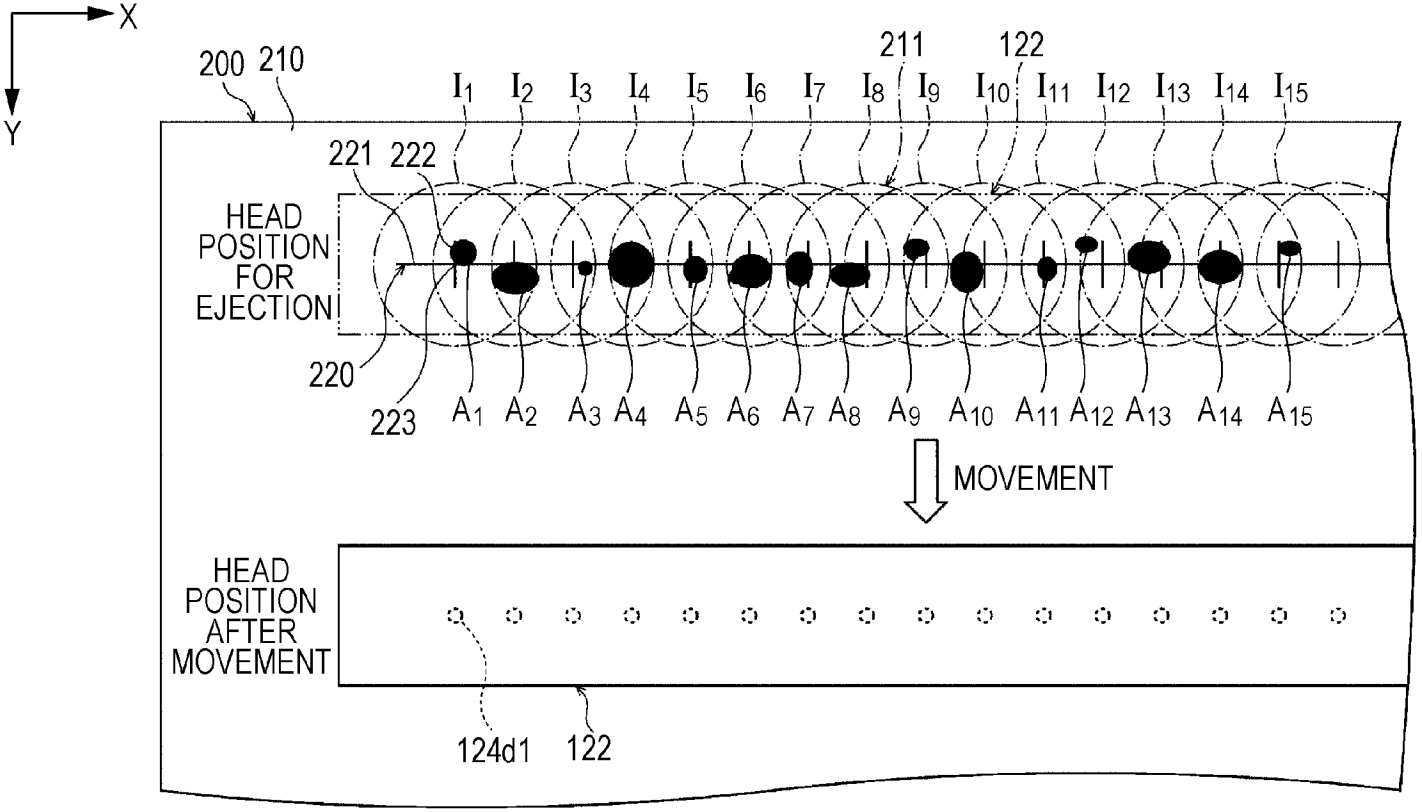
FIG. 5 illustrates an example of a liquid droplet to be measured according to the exemplary embodiment.

Thus, deviation of the drop landing point and the amount of deposited liquid droplet are measured. FIG. 4A is a process chart illustrating a method for inspecting a liquid droplet ejection apparatus according to the present exemplary embodiment. FIG. 4B is a process chart illustrating a method for determining pass or fail in the determination process (step S5) in FIG. 4A. FIG. 5 illustrates an example of a liquid droplet deposited in an inspection region which is a target of pass/fail determination. FIG. 6 illustrates a data table according to the exemplary embodiment.

The method for inspecting a liquid droplet ejection apparatus according to an exemplary embodiment is used to inspect the drop landing accuracy of a liquid droplet ejection apparatus. As illustrated in FIG. 4A, the inspection method includes a preparation process (step S1), an ejection process (step S2), an image capturing process (step S3), a reading process (step S4), and a determination process (step S5). In the preparation process (step S1), the ejection target 200 is placed on the supporting base 111 of the liquid droplet ejection apparatus 100. As illustrated in FIG. 5, a surface 210 of the ejection target 200 has an inspection region 211 having an alignment mark 220 displayed therein. The ejection target 200 may be a test substrate used for inspecting the drop landing accuracy or a half-finished product without a functional layer formed therein. The half-finished product may be a device substrate without, for example, a hole transport layer or a light emitting layer formed therein. Alternatively, the half-finished product may have the alignment mark 220 in the peripheral region (the frame region) thereof, which is a non-light emitting region of a product.

For example, the alignment mark 220 is formed from a straight line 221 extending in the X-axis direction and a plurality of straight lines 222 each extending in the Y-axis direction. Points at which the straight line 221 crosses the straight lines 222 indicate the target positions 223 of the liquid droplets ejected from the ejection ports **124*d*1. Each of the target positions 223 is located so as to correspond to one of the ejection ports 124*d*1. The intervals of the ejection ports 124*d*1 are the same as those of the target positions 223. Note that the format of the alignment mark is not limited to that of the above-described alignment mark. Any mark that allows the target position 223 corresponding to the ejection port 124*d*1** to be identified can be employed.

In the ejection process (step S2), liquid droplets are ejected from the plurality of ejection ports **124*d*1 of the liquid droplet ejection apparatus 100 to the target positions 223 each corresponding to one of the ejection ports 124*d*1. In the ejection process (step S2), the drive frequency for driving the inkjet head 122** is set to a drive frequency that is higher than that used during a normal operation (e.g., during manufacture of a device). As used herein, the drive frequency used for inspection is referred to as an "inspection drive frequency". And the drive frequency set during a normal operation is referred to as an "operation drive frequency". The inspection drive frequency may be set to a value 1.8 times higher than or equal to the operation drive frequency set during a normal operation and 36.7 times lower than the operation drive frequency set during a normal operation.

In the image capturing process (step S3), the inspection region 211 is divided into a plurality of image capturing regions $I_1$ to $I_n$ (image capturing regions $I_1$ to $I_{15}$ in FIG. 5), and the images of the image capturing regions are captured. The images of the image capturing regions $I_1$ to $I_n$ are sequentially captured at different points in time. In this manner, the image of a liquid droplet deposited into each of the image capturing regions is obtained. The inspection region 211 represents the entire image capturing regions $I_1$ to $I_n$. Each of the image capturing regions $I_1$ to $I_n$ is a region whose image can be captured by one image capturing operation performed by the image capturing unit 123. According to the present exemplary embodiment, each of the image capturing regions $I_1$ to $I_n$ has a target position 223 therein. That is, one image capturing operation is performed for one of the target positions 223. Each of the target positions 223 is located at the central point of one of the image capturing regions $I_1$ to $I_n$.

Note that a plurality of the target positions 223 may be present in each of the image capturing regions $I_1$ to $I_n$. By setting a plurality of the target positions 223 in each of the image capturing regions $I_1$ to $I_n$, the number of image capturing operations can be reduced.

In the reading process (step S4), information regarding a liquid droplet is read from each of the images of the liquid droplet obtained in the image capturing process (step S3). More specifically, the positional deviation of each of the liquid droplets from the target position 223 in each of the image capturing regions $I_1$ to $I_n$ is read. Thereafter, in the image capturing regions $I_1$ to $I_n$, the liquid droplets each having a minimum positional deviation are selected as the liquid droplets $A_1$ to $A_n$ for the corresponding target positions 223. In FIG. 5, only the liquid droplets each closest to the target position 223 are illustrated with the reference symbols A1 to An. Thereafter, the area and the positional deviation of each of the liquid droplets are read.

The term "area of a liquid droplet" refers to the project area of the liquid droplet deposited on the surface 210 of the ejection target 200. The area of the liquid droplet can be obtained by, for example, identifying the outline of each of the liquid droplets in plan view and reading the area enclosed by the outline. The term "positional deviation" refers to a distance between the target position 223 and the central point of the liquid droplet. For example, a positional deviation can be obtained by determining the center position of each of the liquid droplets using the outline of the liquid droplet and reading the distance from the central point to the target position.

In the determination process (step S5), it is determined whether the drop landing accuracy of the liquid droplet ejection apparatus meets a predetermined standard on the basis of the areas of the liquid droplets $A_1$ to $A_n$. As illustrated in FIG. 4B, the determination process (step S5) includes a defective ejection port determination process (step S51) and a defective ejection apparatus determination process (step S52). In the defective ejection port determination process (step S51), if, for example, the area of each of the liquid droplets $A_1$ to $A_n$ is outside a predetermined range, it is determined that the ejection port corresponding to the liquid droplet is defective. That is, if the area of a deposited liquid droplet is greater than the upper limit of the predetermined range or if the area of a deposited liquid droplet is less than the lower limit of the predetermined range, it is determined that the corresponding ejection port is defective. Note that only if the area of a deposited liquid droplet is greater than the upper limit of the predetermined range or only if the area of a deposited liquid droplet is less than the lower limit of the predetermined range, it may be determined that the corresponding ejection port is defective. While the above-described exemplary embodiment has been described with reference to determination as to whether the drop landing accuracy is acceptable using the area of a deposited liquid droplet, the characteristic used for determining the pass/fail of the ejection port is not limited to the area of the liquid droplet. For example, pass/fail determination for the ejection port may be made on the basis of deviation of the drop landing position, a variation of the drop landing position, the frequency of the occurrence of non-ejection, the frequency of the occurrence of a satellite phenomenon, or the frequency of the occurrence of a double drop phenomenon.

FIG. 6 illustrates a data table according to the present exemplary embodiment. In the data table in FIG. 6, particular examples of the area of a liquid droplet are illustrated. The field "image capturing region" contains a number corresponding to each of the image capturing regions $I_1$ to $I_n$. The field "area" contains a measurement value of the area of the liquid droplet. The predetermined range of the area of the liquid droplet used for determining pass/fail of an ejection port is defined by, for example, an upper limit of 35 $\mu m^2$ and a lower limit of 20 $\mu m^2$. If the area of a liquid droplet is greater than or equal to the lower limit and less than or equal to the upper limit, it is determined that the area is within the predetermined range. In the example illustrated in FIG. 6, it is determined that the droplets $A_3$ and $A_4$ in the image capturing regions $I_3$ and $I_4$, respectively, are outside the predetermined range. Thus, it is determined that the ejection ports 124*d*1 corresponding to the droplets $A_3$ and $A_4$ are defective. The results of determination of the ejection ports corresponding to the liquid droplets $A_1$ to $A_n$ are stored in the fields "pass/fail determination" in FIG. 6. A mark circle represents "pass", and the mark cross represents "fail".

In the defective ejection apparatus determination process (step S52), it is determined whether the liquid droplet ejection apparatus is continuously usable. More specifically, the ratio of the number of ejection ports determined to be defective in the defective ejection port determination process (step S51) to the total number of ejection ports included in the inkjet head 122 is calculated. Thereafter, it is determined whether the ratio is lower than or equal to a predetermined reference value. If the ratio is lower than or equal to the reference value, it is determined that the liquid droplet ejection apparatus is continuously usable. This is because if the ratio is lower than or equal to the reference value, the liquid solution can be applied to the target by ejecting liquid droplets from only the ejection ports other than the defective ejection ports among all the ejection ports included in the inkjet head 122. Note that if the ratio of the number of defective ejection ports is too high, the number of the ejection ports assigned to a sub-pixel when the liquid solution is applied during a device manufacturing process decreases. Accordingly, the number of liquid droplets assigned to a sub-pixel decreases. Therefore, it may be difficult to provide the amount of dropping liquid required for achieving the designed thickness of the layer. In this regard, the reference value may be set to 8% or less. Note that the reference value described above is only an example. Any appropriate reference value may be set on the basis of, for example, the capacity of a sub-pixel, the number of ejection ports assigned to a sub-pixel, and the amount of liquid to be ejected from each of the ejection ports.

Figure 7:
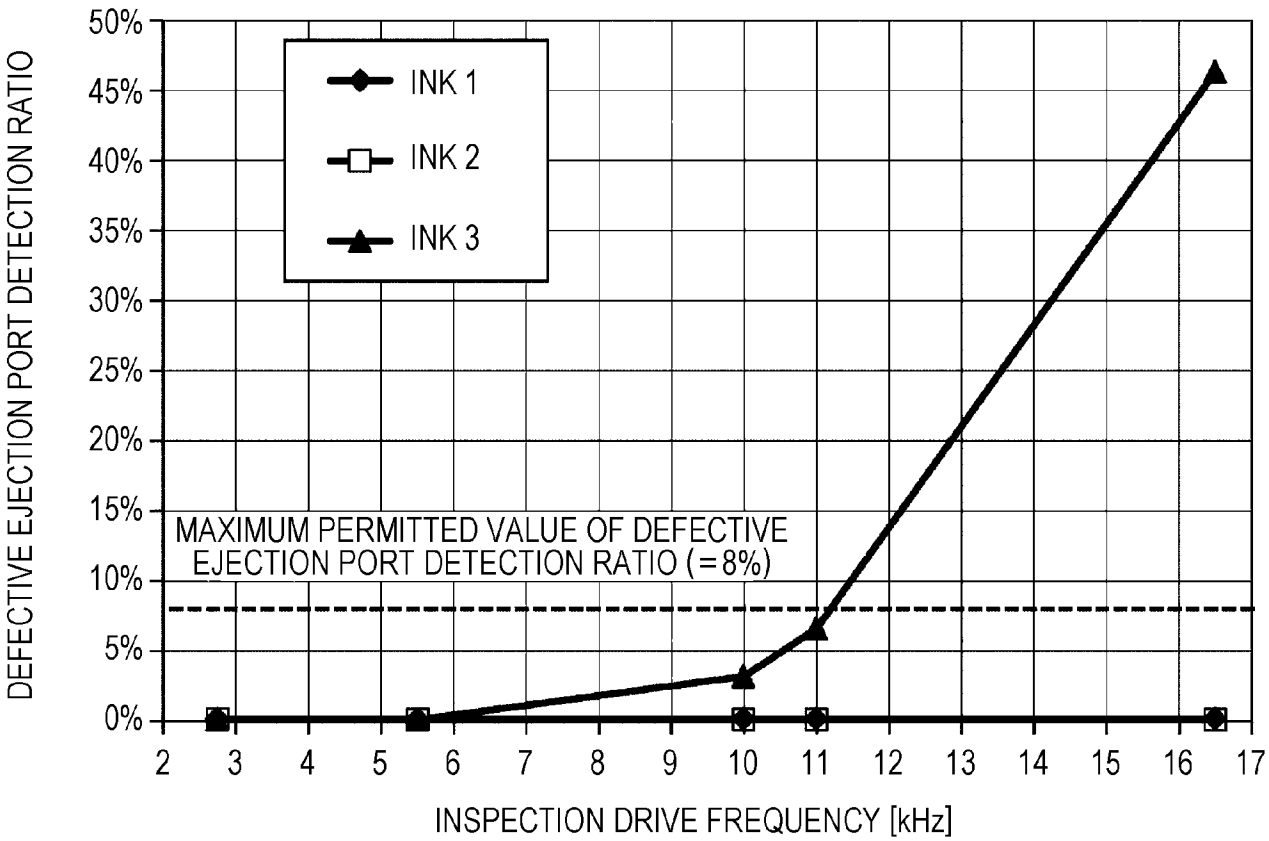
FIG. 7 illustrates an evaluation result indicating a relationship between an inspection drive frequency used in an ejection process (step S2) and the ratio of defective ejection ports in the defective ejection port determination process (step S51)

FIG. 7 illustrates a relationship between the inspection drive frequency used in the ejection process (step S2) and the ratio of the ejection ports that are determined to be defective in the defective ejection port determination process (step S51) to the total number of the ejection ports (a defective ejection port detection ratio). FIG. 8 illustrates the viscosity of ink used in the evaluation in FIG. 7. In FIG. 7, liquid solution is applied to a target, such as a device substrate, during a device manufacturing process. The drive frequency used during a normal operation is about 0.3 to about 5.5 kHz. According to the present exemplary embodiment, the inspection drive frequency is about 10 to 11 kHz.

As illustrated in FIG. 7, when ink 1 and ink 2 are used, the defective ejection port detection ratio does not vary and is maintained at about 0% even if the drive frequency is increased. In contrast, if ink 3 having the highest ink viscosity is used, the defective ejection port detection ratio does not vary and is maintained at about 0% if the drive frequency is lower than or equal to about 5.5 kHz. However, in the range of the drive frequency higher than about 5.5 kHz, the defective ejection port detection ratio increases with increasing drive frequency. It is considered that this is because a supply of the ink to a liquid chamber easily becomes unstable at a high drive frequency when a viscosity of the ink is high. By inspecting an ejection port at a drive frequency higher than about 5.5 kHz in this manner, a potentially defective ejection port that cannot be detected at a drive frequency lower than a drive frequency during a normal operation (e.g., 5.5 kHz) can be detected. Thus, in the device manufacturing process, an ejection port that is likely to accidentally have defective ejection can be detected in advance. And as described above the defective ejection port detection ratio does not vary when ink 1 and ink 2 are used. However when a determination criterion is fixed appropriately, an ejection port that is likely to accidentally have defective ejection can be detected in advance even if such inks are used.

Through the above-described operations, the inspection of the liquid droplet ejection apparatus is completed, and pass or fail of the liquid droplet ejection apparatus is determined on the basis of the obtained result of inspection. If it is determined that the liquid droplet ejection apparatus passed the inspection, a device is manufactured by using the liquid droplet ejection apparatus. However, if it is determined that the liquid droplet ejection apparatus failed the inspection, the liquid droplet ejection apparatus is tuned.

Method for Manufacturing Device

Whole Manufacturing Process of Organic EL Device

FIGS. 9A to 9D are a process chart illustrating a method for manufacturing an organic EL device, which is an example of the method for manufacturing a device according to an exemplary embodiment. A substrate 1 may be formed by applying a photosensitive resin onto a TFT substrate and forming a planarization film by exposure and development using a photomask.

Figure 9A:
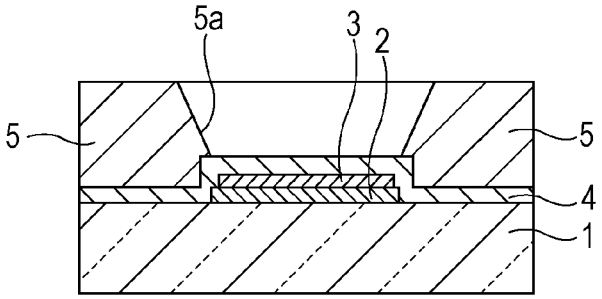
FIGS. 9A to 9D are a process chart illustrating a method for manufacturing an organic EL device, which is an example of a method for manufacturing a device according to the exemplary embodiment.

As illustrated in FIG. 9A, an anode 2, an indium tin oxide (ITO) layer 3, and a hole injection layer 4 are formed on the substrate 1 one on top of the other in this order. Thereafter, banks 5 are formed on the hole injection layer 4. In this manner, a concave portion 5*a* serving as a device forming region is formed between the banks 5. The anode 2 is formed by, for example, patterning, into a matrix, an Ag thin film formed by a sputtering technique using, for example, a lithography process. Note that the Ag thin film may be formed by, for example, a vacuum evaporation technique.

Figure 10A:
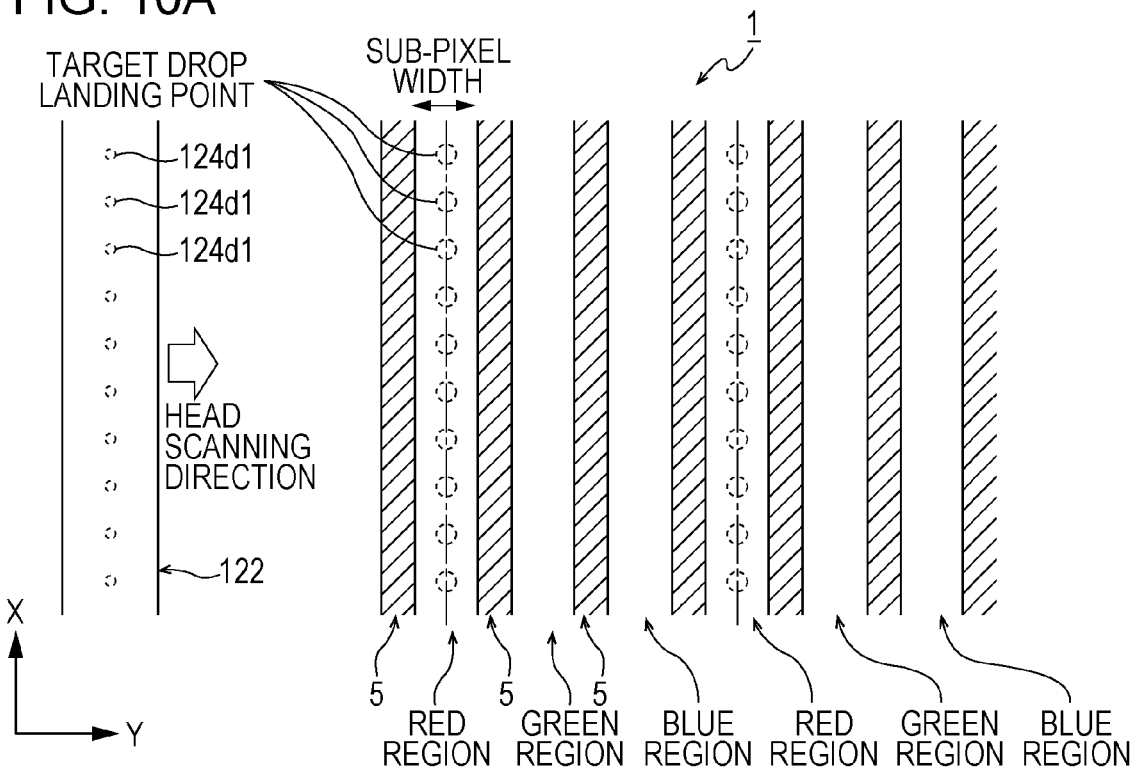
FIG. 10A illustrates an application process of light emitting layer forming ink onto a substrate for production having line banks therein in the method for manufacturing an organic EL device according to the exemplary embodiment and FIG. 10B illustrates an application process of light emitting layer forming ink onto a substrate for production having pixel banks therein in the method for manufacturing an organic EL device according to the exemplary embodiment.

The ITO layer 3 is formed by patterning an ITO thin film formed by a sputtering technique using, for example, a lithography process. The hole injection layer 4 is formed by a vacuum evaporation technique or a sputtering technique using a composition including, for example, $WO_x$ or $Mo_xW_yO_z$. The banks 5 are formed by applying a bank material onto the hole injection layer 4 to form a bank material layer and removing part of the bank material layer by etching. A surface of each of the banks 5 may be subjected to liquid-repellent treatment by, for example, a plasma process using a fluorine-based material. According to the present exemplary embodiment, the bank 5 is a line bank. As illustrated in FIG. 10A, a plurality of line banks are formed on the substrate 1 parallel to one another.

Subsequently, before forming the light emitting layer 6 serving as a functional layer, inspection of the drop landing accuracy is performed in the defective ejection port determination process (step S51). At that time, the above-described method for inspecting an ejection port of the liquid droplet ejection apparatus is employed. Subsequently, a pass/fail determination of the liquid droplet ejection apparatus is made in the defective ejection apparatus determination process (step S52). At that time, the above-described pass/fail determination method for a liquid droplet ejection apparatus is employed.

If a condition predetermined as an acceptability criterion of the inspection is met and, thus, the liquid droplet ejection apparatus passes the inspection, the liquid solution for forming the light emitting layer 6 is applied using the liquid droplet ejection apparatus. However, if the condition predetermined as an acceptability criterion of the inspection is not met and, thus, the liquid droplet ejection apparatus fails the inspection, the liquid droplet ejection apparatus is tuned. To tune the liquid droplet ejection apparatus, the position of the ejection port 124*d*1 at a time of ejection is adjusted if the drop landing position is deviated. The amount of liquid in a droplet ejected from the ejection ports 124*d*1 is adjusted if the area of the liquid droplet is not satisfactory. If one of the ejection ports 124*d*1 that does not eject liquid is found, another one of the ejection ports 124*d*1 adjacent to the one of the ejection ports 124*d*1 is adjusted so that the amount of liquid in a droplet ejected from the adjacent ejection port 124*d*1 is increased. If the liquid droplet is significantly deviated or if the amount of a liquid droplet significantly varies, the ejection port is subjected to, for example, a maintenance operation.

The maintenance operation performed on each of the ejection ports 124*d*1 includes widely known techniques, such as a purge operation, a flushing operation, and wiping operation. In addition, the maintenance operation includes a process to increase or decrease the amount of ink droplet by varying a voltage value applied from the ejection control unit 125 to each of the piezoelectric elements 124*a*. Alternatively, if the lifetime of the inkjet head 122 has expired, the inkjet head 122 may be replaced with a new one. Alternatively, the ink may be adjusted. To adjust the ink, a method for adjusting at least one of the ink density, the ink viscosity, and the ink composition can be employed.

Figure 9B:
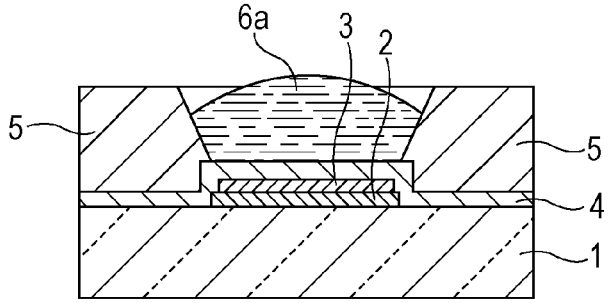

As illustrated in FIG. 9B, the concave portion 5*a* serving as a sub-pixel forming region is located between the banks 5. Subsequently, the concave portion 5*a* is filled with ink containing the material of the organic light emitting layer using an inkjet technique. Thereafter, the filled ink is dried and is subjected to a baking process. Thus, the light emitting layer 6 is formed. At that time, liquid droplets are ejected from the ejection ports other than the ejection port determined to be defective in the defective ejection port determination process (step S51), and the liquid solution is applied to a target. In this manner, a nozzle that may have accidental defective ejection during the manufacturing process can be detected in the pre-stage of a device manufacturing process. Thus, a device can be manufactured without using such a defective nozzle.

Figure 9C:
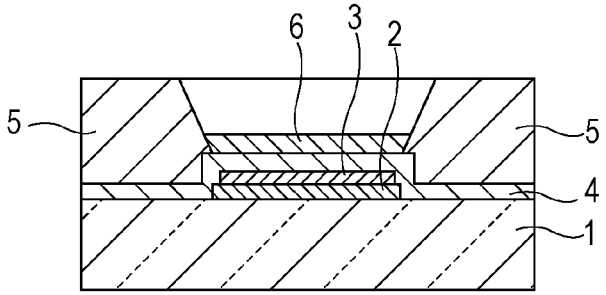

FIGS. 9A to 9D illustrate a pair of the banks 5. In reality, a plurality of banks are formed in the substrate 1 parallel to one another in the lateral direction of the plane of FIGS. 9A to 9D. One of a red light emitting layer, a green light emitting layer, and a blue light emitting layer is formed between the adjacent banks. In this process, ink 6*a* containing one of the materials of the red light emitting layer, the green light emitting layer, and the blue light emitting layer is loaded. Thereafter, by drying the loaded ink 6*a* under a reduced pressure, the light emitting layer 6 is formed as illustrated in FIG. 9C.

Figure 9D:
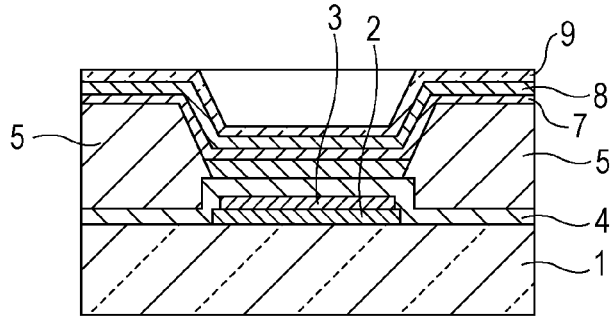

Note that although not illustrated in FIGS. 9A to 9D, a hole transport layer serving as a functional layer may be formed under the light emitting layer 6 by a wet process. In addition, an electron transport layer serving as a functional layer may be formed above the light emitting layer 6 by a wet process. Subsequently, as illustrated in FIG. 9D, an electron injection layer 7, a cathode 8, and a sealing layer 9 are sequentially formed. To form the electron injection layer 7, a barium thin film may be formed using, for example, the vacuum evaporation technique.

To form the cathode 8, an ITO thin film may be formed by, for example, a sputtering technique. The sealing layer 9 may be formed by applying a resin sealing material and irradiating the resin sealing material with ultraviolet (UV) light to cure the resin sealing material. Furthermore, by placing sheet glass on the cured resin sealing material, the cathode 8 may be sealed. Through such processes, an organic EL device is manufactured. Note that according to the present exemplary embodiment, the liquid droplet ejection apparatus is inspected before the light emitting layer 6 serving as a functional layer is formed. However, the timing at which the liquid droplet ejection apparatus is inspected is not limited thereto. For example, at least one inspection operation may be performed using an inkjet technique before any one of the functional layers is formed.

Method for Applying Liquid Solution for Forming Light Emitting Layer

A method for performing the process for forming the light emitting layer 6 using the liquid droplet ejection apparatus 100 in a mass production manner is described below. To form the light emitting layer 6, three colors of ink, that is, red ink, green ink, and blue ink, which are the liquid solution for forming the light emitting layer 6, are used. By using such ink, a red light emitting layer, a green light emitting layer, and a blue light emitting layer are formed in regions between every two adjacent line banks.

For simplicity, different colors of ink are sequentially applied to all of a plurality of substrates. That is, the ink of a first color is applied to all the substrates. After the ink of the first color is applied to all the substrates, the ink of a second color is applied to all the substrates. Finally, ink of a third color is applied to all the substrates. A process for applying the ink of a first color (e.g., red ink) to a plurality of substrates is described below.

A process for applying ink for forming a light emitting layer using the liquid droplet ejection apparatus 100 is described next with reference to FIGS. 1 and 10A. In the process, the substrate 1 for production is placed on the work table 110 first. Thereafter, ink for forming a light emitting layer is applied to the substrate 1.

Process for Line Bank

As illustrated in FIG. 9A, the anode 2, the ITO layer 3, the hole injection layer 4, and the banks 5 are formed on the substrate 1.

As illustrated in FIG. 10A, the substrate 1 is placed on the work table 110 with the banks 5 extending in the X-axis direction. The inkjet head 122 that extends in the X-axis direction is scanned in the Y-axis direction. At the same time, ink is ejected from the ejection ports 124*d*1. The ink is ejected toward the target position set between two adjacent line banks. Note that a region to which red ink is applied is one of three regions arranged adjacent to each other in the X-axis direction.

In the application process, the ejection ports 124*d*1 other than the ejection ports determined to be defective in the defective ejection port determination process (step S51) are used on the basis of the management table stored in the storage unit 132. That is, the ejection ports 124*d*1 determined to be defective in the defective ejection port determination process (step S51) are not used. If application of the ink to N substrates 1 for production is completed, ink of another color is applied to the same substrates 1. Thereafter, ink of a third color is applied to the same substrates 1. In this manner, three colors of ink are applied to the plurality of substrates.

Process for Grid Pixel Bank

Figure 10B:
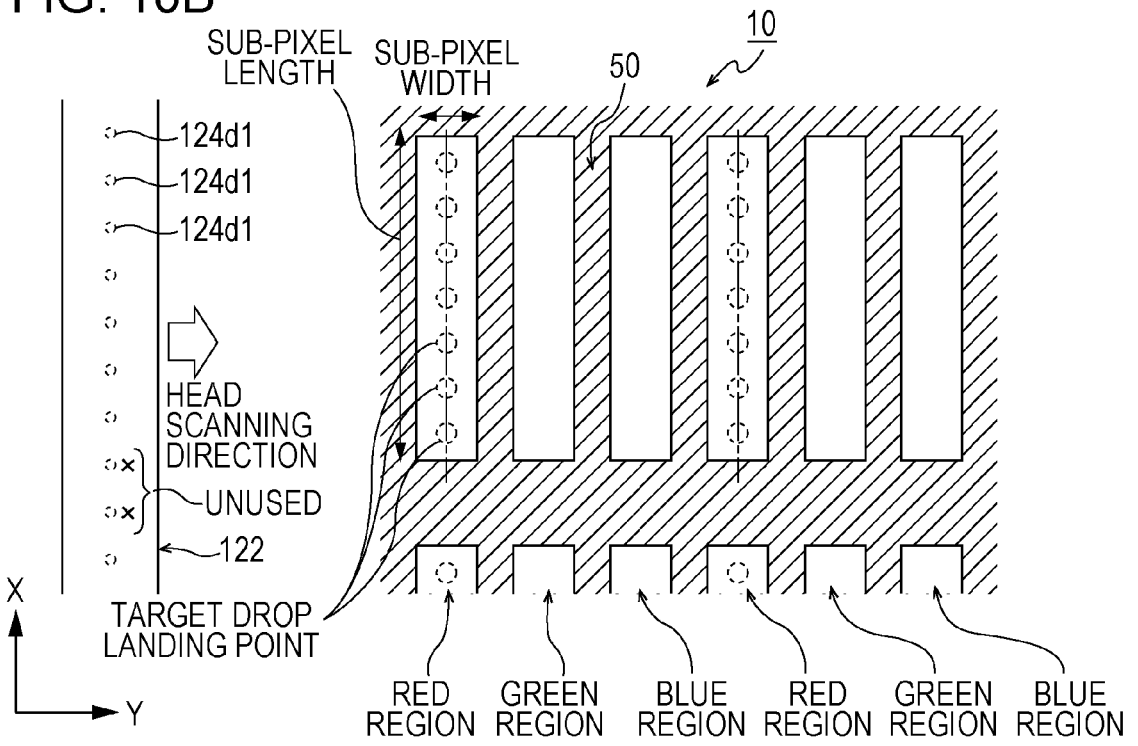

In the above-described exemplary embodiment, the bank is a line bank. In contrast, according to the present exemplary embodiment, as illustrated in FIG. 10B, a grid pixel bank is formed in a substrate 10 for production. In this manner, a structure in which sub-pixels are defined by a rectangular pixel bank may be employed.

In a process for applying ink to a substrate for production, the substrate for device production 10 having pixel banks 50 formed therein is placed on the work table 110 of the liquid droplet ejection apparatus 100 first. Thereafter, ink is applied to a region that makes the sub-pixels defined by the pixel bank 50. At that time, the substrate for production 10 is placed so that the long direction of each of the sub-pixels coincides with the X-axis direction and the width direction of the sub-pixel coincides with the Y-axis direction. Subsequently, the inkjet head 122 is scanned in the Y-axis direction to eject ink from each of the ejection ports. As illustrated in FIG. 10B, the ink is ejected toward the target positions set in the red sub-pixel region.

Note that as illustrated in FIG. 10B, among the ejection ports 124*d*1 of the inkjet head 122, the ejection ports that does not move above the sub-pixel region (the ejection ports each indicated by a cross in FIG. 10B) are not used at all times. This design is different from that of the first exemplary embodiment. In the example illustrated in FIG. 10B, seven target positions are set in one sub-pixel region. The ink is ejected from each of the seven ejection ports 124*d*1 toward a corresponding one of the seven target positions.

In the application process, the ejection ports 124*d*1 other than the ejection ports determined to be defective in the defective ejection port determination process (step S51) are used on the basis of the management table stored in the storage unit 132. That is, the ejection ports 124*d*1 determined to be defective in the defective ejection port determination process (step S51) are not used.

If application of the ink to N substrates 1 for production is completed, ink of another color is applied to the same substrates 1. Thereafter, ink of a third color is applied to the same substrates 1. In this manner, three colors of ink are applied to the plurality of substrates.

Summary

As described above, according to the method for inspecting an ejection port of the liquid droplet ejection apparatus of the present exemplary embodiment, the ejection port is inspected in the defective ejection port determination process (step S51). In this inspection, liquid droplets are ejected to the ejection target 200 at an inspection drive frequency that is higher than a drive frequency usually used in a device manufacturing process. If the area of each of the liquid droplets $A_1$ to $A_n$ deposited onto the ejection target 200 is outside a predetermined range, it is determined that the ejection port corresponding to the one of the liquid droplets $A_1$ to $A_n$ is defective.

In this manner, a potentially defective ejection port that cannot be detected at a drive frequency used during a normal operation in a device manufacturing process can be detected. In addition, according to the method for inspecting a liquid droplet ejection apparatus of the present exemplary embodiment, in the defective ejection apparatus determination process (step S52), it is determined whether the liquid droplet ejection apparatus is continuously usable. More specifically, it is determined whether the ratio of the number of ejection ports determined to be defective in the defective ejection port determination process (step S51) to the total number of ejection ports included in the inkjet head 122 is lower than or equal to a reference value. If the ratio is lower than or equal to the reference value, it is determined that the device manufacturing operation can be continuously performed by ejecting liquid droplets from only the ejection ports other than the ejection ports that are determined to be defective.

In this manner, ejection ports that are likely to have accidental defective ejection in the manufacturing process can be detected and selected out. Thus, the liquid solution can be applied to a target without using the defective ejection ports. As a result, a decrease in the yield ratio can be prevented and, thus, the production efficiency can be increased.

Modifications (1) According to the above-described exemplary embodiment, if the area of each of the liquid droplets $A_1$ to $A_n$ is outside a predetermined range, it is determined that the corresponding ejection port is defective in the defective ejection port determination process (step S51). However, the pass/fail determination may be made using other characteristics of a deposited liquid droplet. For example, pass/fail determination for the ejection port may be made on the basis of at least one of the area of the liquid droplet, deviation of the drop landing position, a variation of the drop landing position, the frequency of the occurrence of non-ejection, the frequency of the occurrence of a satellite phenomenon, or the frequency of the occurrence of a double drop phenomenon. More specifically, in the defective ejection port determination process (step S51), liquid droplets are ejected to the ejection target 200 at an inspection drive frequency that is higher than a drive frequency usually used in a device manufacturing process. Thereafter, at least one of the above-described characteristics is measured. If each of the results of measurement is outside a predetermined range set for the corresponding characteristic, it may be determined that the ejection port is defective.

As used herein, the term "deviation of the drop landing position" refers to a distance between the center position of each of the deposited liquid droplets $A_1$ to $A_n$ and the target position 223. The term "variation of the drop landing position" refers to a value obtained by measuring the deviation of the drop landing position for each of the ejection ports a plurality of times and quantifying the level of the variation. The term "frequency of the occurrence of non-ejection" refers to the frequency of the occurrence of a situation in which a liquid droplet is not ejected when each of the ejection ports ejects a liquid droplet a plurality of times. The term "frequency of the occurrence of a satellite phenomenon" refers to the frequency of the occurrence of a phenomenon in which small satellite drops appears in the vicinity of the liquid droplet. The term "frequency of the occurrence of a double drop phenomenon" refers to the frequency of the occurrence of a phenomenon in which when a drop landing inspection pattern is formed by two droplets ejected from the same ejection port, the distance between the landing position of the first droplet and the landing position of the second droplet is large and, thus, the two droplets do not form one pattern.

At least one of these characteristics may be selected as an inspection item. Like the example of the exemplary embodiment, even when such an inspection item is used, a potentially defective ejection port that cannot be detected at a normal drive frequency can be detected.

(2) While the above exemplary embodiment has been described with reference to sequential application of ink of three colors to a plurality of substrates one color by one color, the above-described inspection method is applicable even when three colors of ink are simultaneously applied. For example, the above-described series of processes may be performed for the heads corresponding to the three colors in parallel. In this manner, an effect that is the same as the effect described in the above-described exemplary embodiment can be provided.

(3) The above exemplary embodiment has been described with reference to the example in which the manufacturing method of the present disclosure is applied to the process for forming the light emitting layer of an organic EL device. In addition to a light emitting layer, the manufacturing method of the present disclosure is applicable to formation of another functional layer, such as a hole injection layer or an electron injection layer, using a wet process and formation of an organic semiconductor layer of a TFT substrate using a wet process. Even in such a case, the same effect can be provided.

(4) The order in which the above-described processes are performed is only an example for describing the present disclosure in detail. The order is not limited to the above-described order. In addition, part of the above-described process may be performed simultaneously with (parallel to) another process. Furthermore, at least part of the exemplary embodiment and at least part of the modification may be combined with each other. Still furthermore, a variety of modifications of the present exemplary embodiment containing a change in the range a person skilled in the art can conceive are encompassed within the scope of the present disclosure.

Supplementary Note

The above-described embodiments are only particular examples of the present disclosure. The values, shapes, materials, components, the positions and connection form of the components, processes, and the order of the processes described in the embodiments are merely for illustrative purposes only and are not meant to be limiting on the scope of the present disclosure. Note that among the components of the embodiments, a process that is not described in independent claims representing the highest level of the concept is an optional component.

Furthermore, it will be appreciated that for ease of understanding of the disclosure, the components illustrated in the drawings of the above-described embodiments may not necessarily be drawn to scale. Still furthermore, it should be understood that this disclosure is not intended to be limited by the illustrative embodiments, and various modifications or changes can be made without departing from the scope of the present disclosure.

In addition, application apparatuses have circuit components and members, such as lead wires, disposed on a substrate. The electric wiring and the electric circuits can be mounted in a variety of forms using widely-used techniques in the technical field. These forms are not described herein since these are not directly related to the scope of the present disclosure. It is also to be understood that the above-described drawings are schematic illustrations and are not necessarily precise illustrations.

The present disclosure is widely applicable to, for example, manufacturing of passive-matrix or active matrix organic light emitting elements and devices, such as a TFT substrate.

What is claimed is:

1. A method for inspecting a liquid droplet ejection apparatus that ejects a liquid droplet from an ejection port, comprising:

(a) ejecting the liquid droplet toward an ejection target at an inspection drive frequency that is higher than an operation drive frequency set during a normal operation;

(b) measuring a characteristic of the liquid droplet deposited on a surface of the ejection target;

(c) determining that the ejection port the characteristic of which is outside a predetermined range is defective; and wherein the inspection drive frequency is 1.8 times higher than or equal to the operation drive frequency and 36.7 times lower than the operation drive frequency.

2. The method for inspecting a liquid droplet ejection apparatus according to claim 1, wherein the measuring (b) includes:

(b-1) capturing an image of the liquid droplet deposited on the surface of the ejection target; and (b-2) measuring the characteristic on the basis of the image.

3. The method for inspecting a liquid droplet ejection apparatus according to claim 1, wherein the characteristic is at least one of an area of the liquid droplet, deviation of a drop landing position of the liquid droplet, a variation of the drop landing position, a frequency of an occurrence of non-ejection, a frequency of an occurrence of a satellite phenomenon, and a frequency of an occurrence of a double drop phenomenon.

4. A method for inspecting a liquid droplet ejection apparatus that ejects a liquid droplet from an ejection port, comprising:

(a) ejecting the liquid droplet toward an ejection target at an inspection drive frequency that is higher than an operation drive frequency set during a normal operation;

(b) measuring a characteristic of the liquid droplet deposited on a surface of the ejection target;

(c) determining that the ejection port the characteristic of which is outside a predetermined ran e is defective; and (d) determining that it is possible for the normal operation to be continuously performed by using ejection ports other than one or more ejection ports determined to be defective in the determining (c), in a case where a ratio of a number of the one or more ejection ports determined to be defective in the determining (c) to a total number of ejection ports is lower than or equal to a predetermined value.

5. The method for inspecting a liquid droplet ejection apparatus according to claim 4, wherein the predetermined value is less than or equal to 8%.

6. The method for inspecting a liquid droplet ejection apparatus according to claim 4, wherein the measuring (b) includes:

(b-1) capturing an image of the liquid droplet deposited on the surface of the ejection target; and (b-2) measuring the characteristic on the basis of the image.

7. The method for inspecting a liquid droplet ejection apparatus according to claim 4, wherein the characteristic is at least one of an area of the liquid droplet, deviation of a drop landing position of the liquid droplet, a variation of the drop landing position, a frequency of an occurrence of non-ejection, a frequency of an occurrence of a satellite phenomenon, and a frequency of an occurrence of a double drop phenomenon.

* * * * *